US007441380B2

(12) United States Patent
Andrä et al.

(10) Patent No.: US 7,441,380 B2
(45) Date of Patent: Oct. 28, 2008

(54) TIE ANCHOR FOR A STRIP-TYPE TENSION MEMBER

(75) Inventors: Hans-Peter Andrä, Stuttgart (DE); Gert König, Frankfurt am Main (DE); Markus Maier, Plieningen (DE)

(73) Assignee: Leonhard, Andrä und Partner Beratende Ingenieure VBI GmbH, Stuttgart (DE)

( * ) Notice: Subject to any disclaimer, the term of this patent is extended or adjusted under 35 U.S.C. 154(b) by 1019 days.

(21) Appl. No.: 10/481,181

(22) PCT Filed: Jun. 14, 2002

(86) PCT No.: PCT/EP02/06572

§ 371 (c)(1),
(2), (4) Date: Jun. 25, 2004

(87) PCT Pub. No.: WO02/103137

PCT Pub. Date: Dec. 27, 2002

(65) Prior Publication Data

US 2004/0216403 A1 Nov. 4, 2004

(30) Foreign Application Priority Data

Jun. 19, 2001 (DE) ..... 101 29 216

(51) Int. Cl.
*E04C 5/08* (2006.01)

(52) U.S. Cl. ..... 52/223.13; 14/21; 267/164

(58) Field of Classification Search ..... 52/223.1, 52/223.8–233.14; 14/21, 74.5; 254/29; 29/446, 29/897.34, 897.35; 403/204; 267/47, 164
See application file for complete search history.

(56) References Cited

U.S. PATENT DOCUMENTS

| | | | | | |
|---|---|---|---|---|---|
| 457,291 | A | * | 8/1891 | Pulliam | 14/74.5 |
| 3,102,722 | A | * | 9/1963 | Hamontre | 267/47 |
| 4,068,435 | A | * | 1/1978 | Scott | 52/223.1 |
| 4,173,857 | A | * | 11/1979 | Kosaka | 52/223.8 |
| 4,767,134 | A | * | 8/1988 | Booher | 267/47 |
| 5,479,748 | A | | 1/1996 | Siller | |
| 5,671,572 | A | * | 9/1997 | Siller-Franco | 52/223.8 |
| 6,584,738 | B1 | | 7/2003 | Andrä et al. | |

FOREIGN PATENT DOCUMENTS

| | | | |
|---|---|---|---|
| JP | 07-189427 | | 7/1995 |
| SU | 768908 B | * | 10/1978 |

* cited by examiner

*Primary Examiner*—Richard E. Chilcot, Jr.
*Assistant Examiner*—Matt J Smith
(74) *Attorney, Agent, or Firm*—Drinker Biddle & Reath LLP

(57) ABSTRACT

A tie anchor for strip-type tension members includes an anchor body disposed on at least one side of the tension member. The anchor body includes a plurality of clamping blocks arranged at a distance from each other in a longitudinal direction of the tension member. The clamping blocks are connected to tension member by adhesive and/or friction (clamping friction). An end-most (final) one of the clamping blocks is attached to a fixed abutment. Adjacent clamping blocks are interconnected by expansion members whose spring stiffness becomes progressively stronger toward the end-most clamping block.

16 Claims, 9 Drawing Sheets

Fig. 1
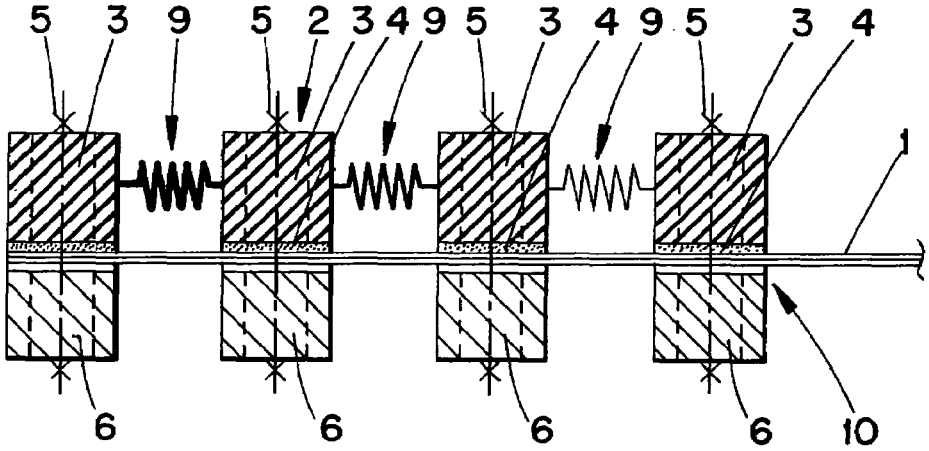
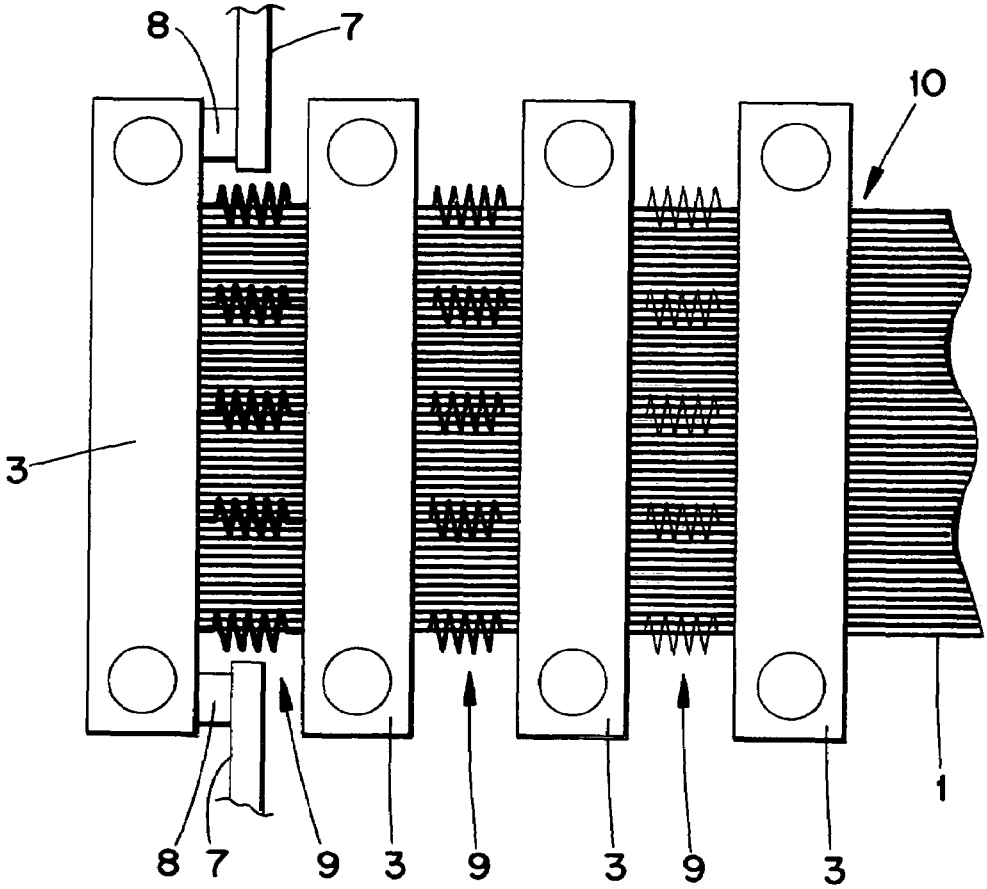
Fig. 2

Fig. 6
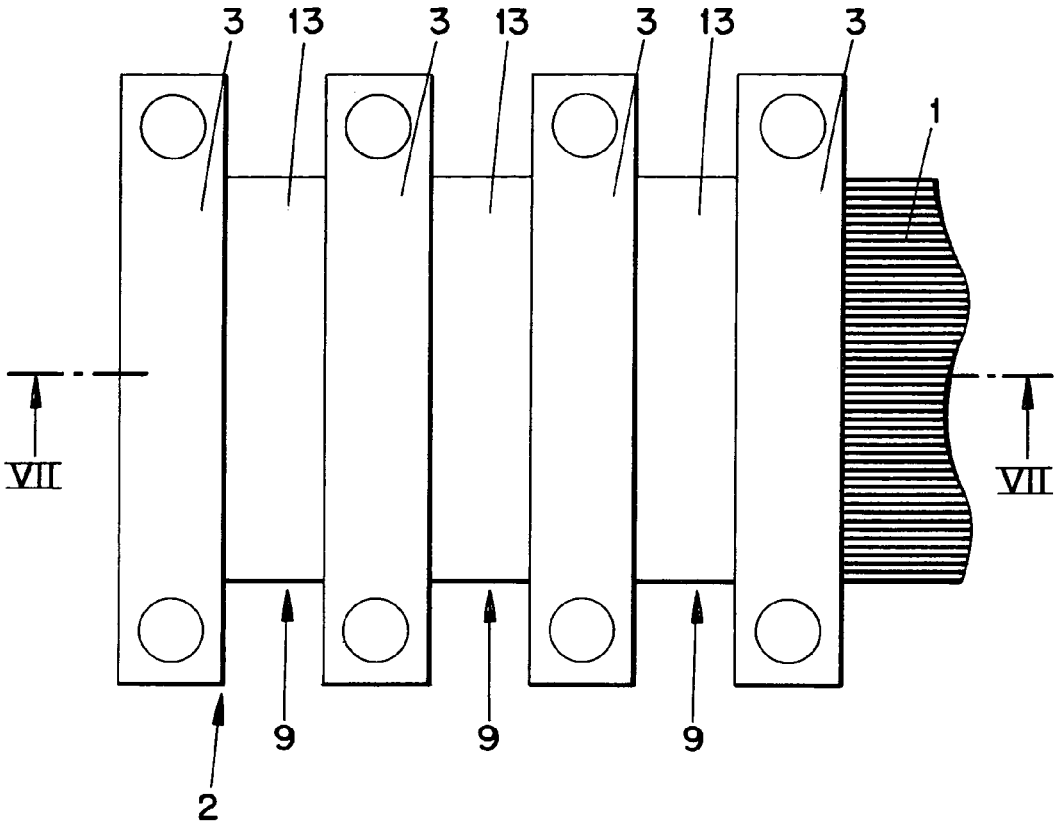
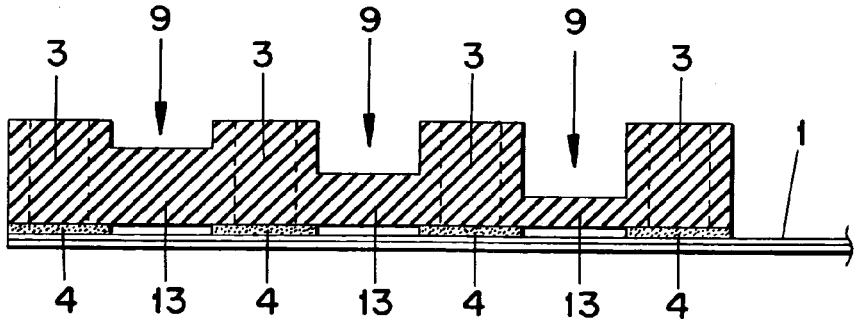
Fig. 7

Fig. 10
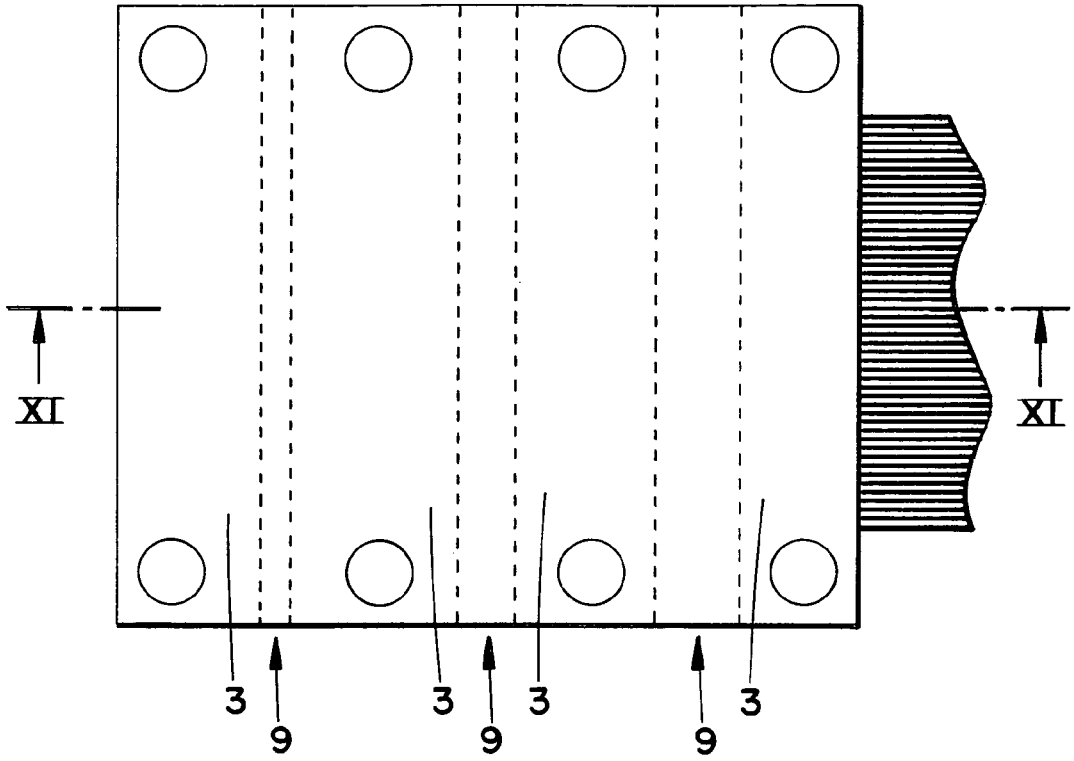
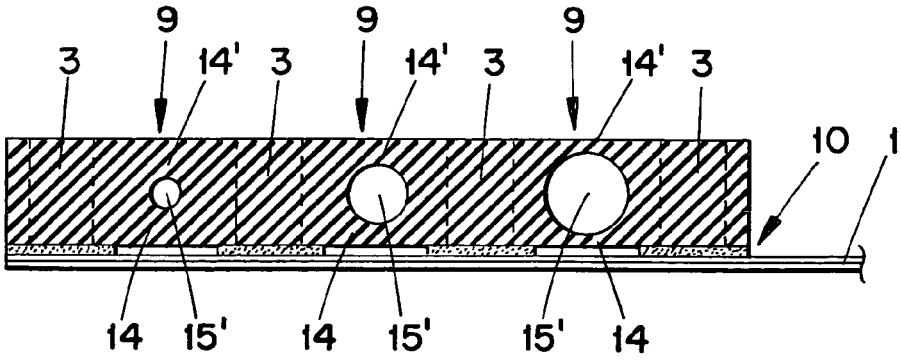
Fig. 11

Fig. 12
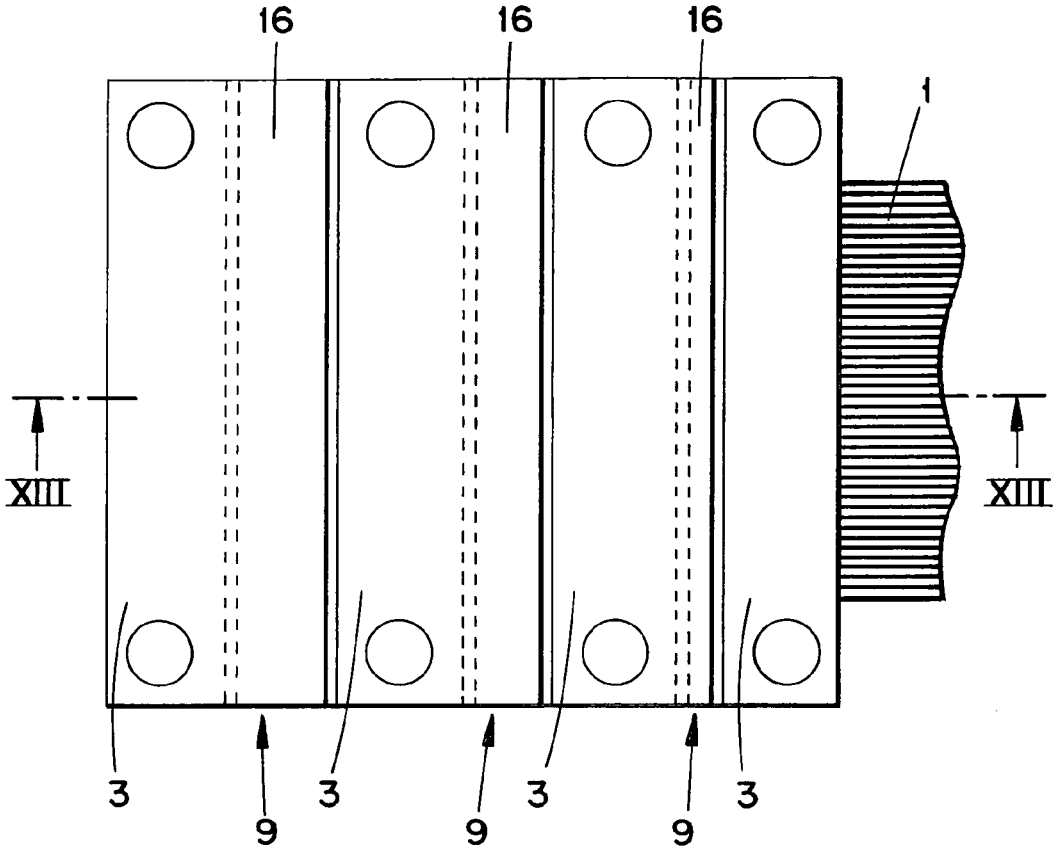
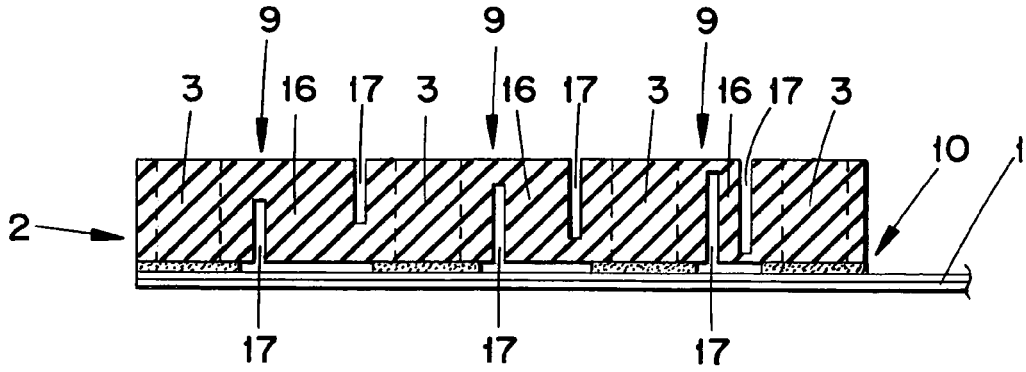
Fig. 13

Fig. 14
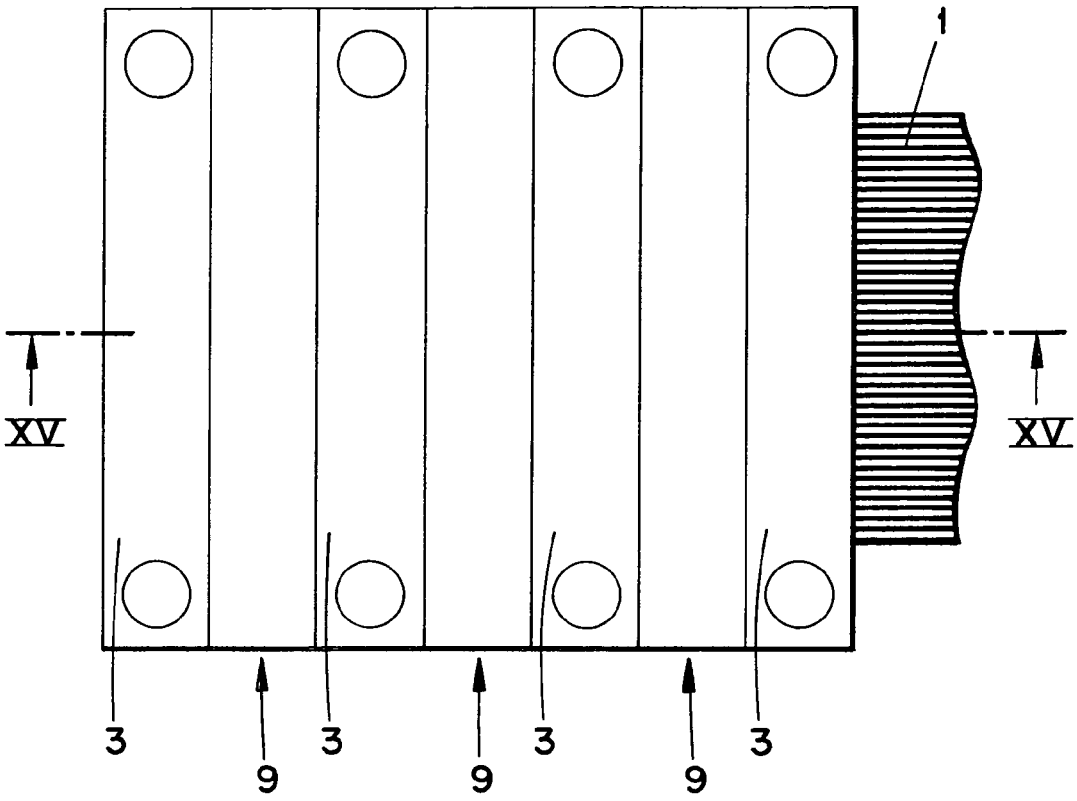
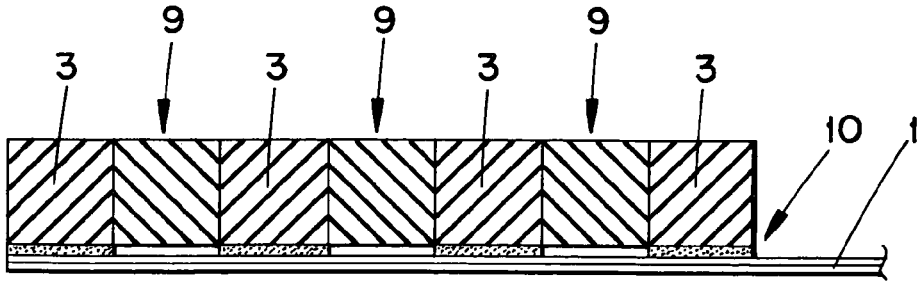
Fig. 15

TIE ANCHOR FOR A STRIP-TYPE TENSION MEMBER

BACKGROUND OF THE INVENTION

The invention relates to a tie rod (tie anchor) for strip-type tension members used in the building trade, especially fiber-reinforced plastic lamellae having at least one anchoring body positively connected to the tension member by means of adhesion and/or friction whereby said anchoring body can be supported on a fixed abutment.

It is known in the art to attach pretensioned strip-type tension members on the outside of the supporting framework after erection to increase the load capacity (strengthening) or to restore the original load capacity (reconstruction) of supporting frameworks made of reinforced concrete or prestressed concrete. Fiber-reinforced plastic lamellae are preferably used for this purpose aside of steel lamellae (bands), especially synthetic materials reinforced with carbon fibers, synthetic materials reinforced with aramide, and synthetic materials reinforced with glass fibers.

A significant characteristic of these fiber-reinforced synthetic materials, in particular the preferably employed synthetic materials reinforced with carbon fibers, is the fact that the strip-type tension members made from these materials show linear elastic behavior up to the breaking point. Attention must be given in the necessary anchoring of the end pieces of the tension members to maintain single-axis tensile stress conditions. A dual-axis tensile stress condition caused by substantial stress spikes at the clamping point and/or at the point of deflection would lead to damage or even to destruction of the strip-type tension member.

The transition point from the free span length of the tension member to the anchoring zone is non-uniform in terms of stiffness, specifically at the adhesive attachment of the strip-type tension member to the anchoring bodies short and which absorbs the load initiated by the tension member through shearing stress whereby said spike in shearing stress exceeds the locally admissible shearing stress in the adhesive joint and reaches the ultimate stress (breaking stress). The crucial breaking criteria in case of the use of an adhesive is hereby the exceeding of cohesion of the adhesive and/or the breaking of the plastic matrix of the strip-type tension member. The thereby formed breaking shear-stress front moves along the adhesive joint until the adhesive connection breaks down completely.

It is know from prior art (DE 198 49 605 A1 and corresponding to U.S. Pat. No. 6,584,738) to apply an additional clamping force between the anchoring body and the tension member glued thereto to increase the adhesive effect. The thereby developing dual-axis stress condition (longitudinal stress/limited transverse pressure) is harmless for the tension member since no transverse stress occurs. There occurs rather an increase of the crucial breaking strength. However, the spike in shearing stress is thereby not decreased at the transition from the free span length to the anchoring zone.

For the solution of the problem of decreasing or of avoiding a spike in shearing stress at the transition from the free span length into the anchoring zone, it has been proposed in prior art to alter the adhesive characteristics along the force introduction area in such a manner whereby a relatively soft adhesive is used at the transition to the anchoring (less shear modulus) and the adhesive characteristics on the other end of the anchoring is altered in such a way that the adhesive is provided with a high shear modulus and whereby the adhesive acts substantially stiffer. However, the selection of adhesive material and especially the maintaining of set conditions in the application of the adhesive demand very high requirements and they are not controllable, especially after application.

It is also known from prior art to embed a perforated metal plate or similar material in the adhesive joint. A generally lower shear modulus of the adhesive joint is achieved thereby without reducing the total load capacity. The damaging spike in shearing stress can, nevertheless, be reduced thereby—but not to a sufficient degree in many cases of application.

It is therefore the object of the invention to design a tie rod of the aforementioned type in such a manner that the development of a spike in shearing stress is avoided which locally exceeds the ultimate stress in the adhesive joint or in the region of friction.

SUMMARY OF THE INVENTION

This object is achieved according to the invention in that the anchor body is provided with a plurality of clamping blocks, which are arranged at a distance from each other in longitudinal direction of the tension member and which are connected to said tension member by means of adhesion and/or friction whereby the last clamping block toward the end of the tension member can be supported on the fixed abutment, whereby the clamping blocks are interconnected by extension sections having different degrees of spring stiffnesses, and whereby the spring stiffnesses of said extension sections increase toward the end of the tension member.

Achieved is thereby, nevertheless, a stepped but still sufficiently uniform declining gradient of the transferred tensile force in the adhesive joint or in the region of friction from the transition of the free span length to the anchoring. The shearing stress is reduced up to the transition into the free span length of the tension member to such a degree that neither the cohesion of the adhesive nor the maximal possible friction force is exceeded at this point or that damage occurs to the tension member itself.

According to a preferred embodiment of the invention, it is proposed that an anchoring body is arranged on both sides of a strip-type tension member or on a layer of two strip-type tension members whereby the clamping blocks of said anchoring body stacked on top of one another are connected to each other by means of clamping elements. The clamping elements are preferably tension bolts arranged at both sides adjacent to the tension member. The varying elastic extension sections, which means, extension sections designed having different spring stiffnesses, are made constructively very simple and can be manufactured in a simple manner as connecting pieces having different cross sections. The different cross sections of the connecting pieces, which can be produced in several ways as described below, lead to varying spring stiffnesses. The requirement of designing the spring stiffness of the extension sections to increase toward the end of the tension member can be realized thereby in a very simple manner.

BRIEF DESCRIPTION OF THE DRAWINGS

Embodiment examples of the invention, which are illustrated in the drawings, are explained in more detail in the following:

FIG. 1 shows in a longitudinal section a highly schematic illustration of a tie rod for a strip-type tension member whereby spring symbols are used for the extension sections of varying spring stiffness;

FIG. 2 shows a top view onto the schematically illustrated tie rod in FIG. 1;

FIG. 6 shows a top view onto a tie rod according to the first embodiment;

FIG. 7 shows a sectional view along line VII-VII in FIG. 6;

FIG. 8 through FIG. 12 show additional embodiment examples in illustrations according to FIG. 6 and FIG. 7.

DETAILED DESCRIPTION OF PREFERRED EMBODIMENTS OF THE INVENTION

Figure 3:
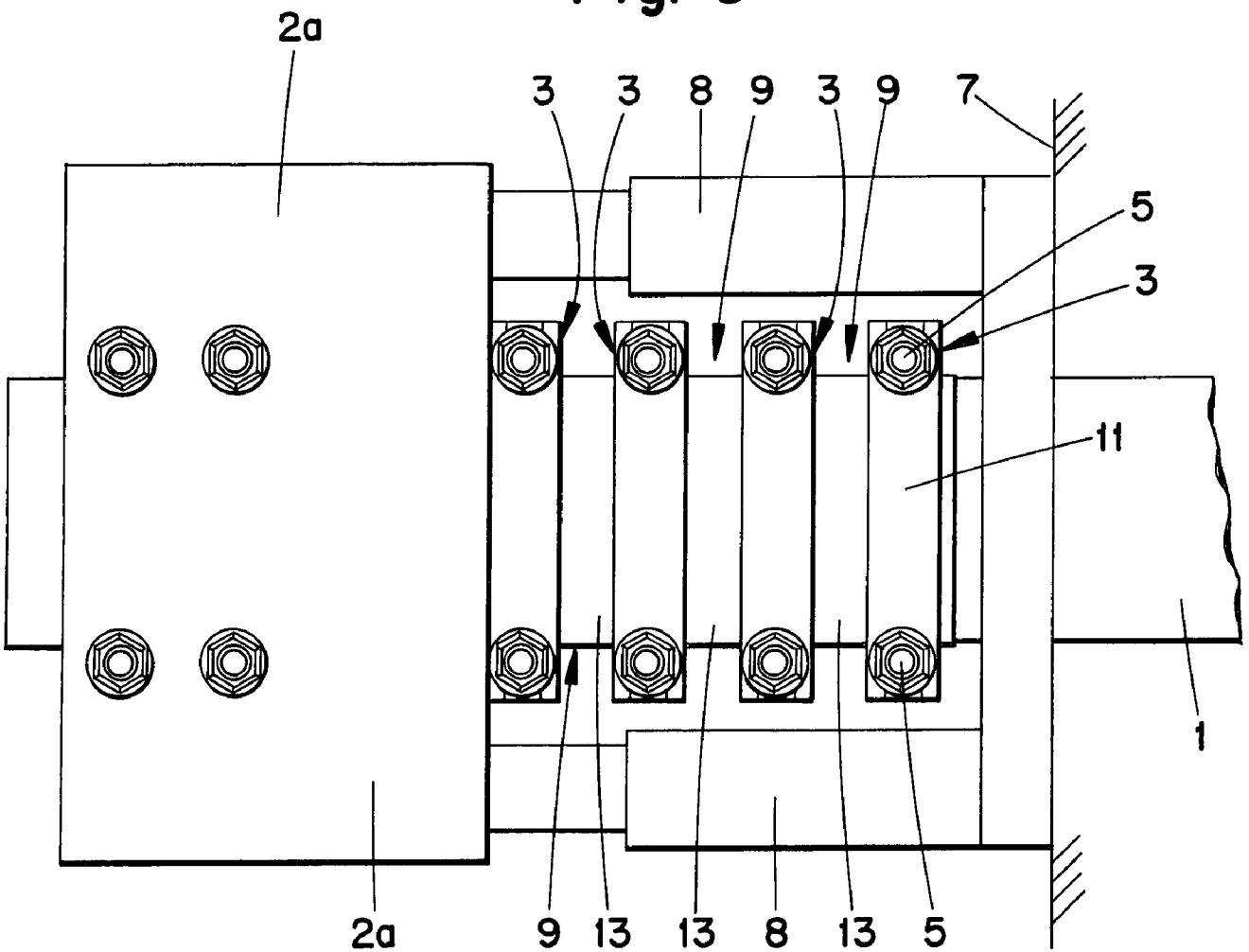
FIG. 3 shows a top view onto an embodiment example of a tie rod for a strip-type tension member.

The basic design of a tie rod for a strip-type tension member 1, consisting of lamellae made of synthetic material reinforced with carbon fibers, is explained with the aid of FIG. 1 and FIG. 2. These strip-type tension members 1 are employed in the building trade for strengthening or reconstruction of supporting frameworks made of prestressed concrete or reinforced concrete. The strip-type tension members are attached onto the concrete surface through adhesion, for example, or are placed on the concrete surface without any bonding material. The described tie rods serve to create prestress and/or terminal anchoring for tension members.

An anchoring body 2 is bonded hereby to the tension member 1 through adhesion and clamping. Instead, bonding can also be achieved through friction. The adhesive bond is described in the following as one of the possible embodiment examples. The anchoring body 2 is provided with a plurality of clamping blocks 3 arranged at a distance from each other in longitudinal direction of the tension member 1. Each of the clamping blocks 3 is connected to the tension member 1 by adhesion through an adhesive layer 4. Each clamping block is connected to a clamping counterpiece 6 by means of clamping bolts 5, which are indicated only schematically in FIG. 1. Said clamping counterpieces 6 can, in turn, be parts of a second clamping body 2 at the bottom of the tension member 1.

The last clamping block 3 toward the end of the tension member, which is the clamping block 3 arranged to the very left in the illustrated embodiment example, is supported by connectors 8 on a fixed abutment 7 attached to the supporting frame via a hydraulic tensioning device, for example.

Extension sections 9 are provided between the individual clamping blocks 2 whereby said extension sections are symbolized as groups of springs in the illustration of FIG. 1 and FIG. 2. The varying thickness of the tension springs show that the extension sections 9 are designed having different spring stiffnesses whereby the spring stiffness increases from the transition point 10 of the free span length of the tension member 1 into the anchoring zone toward the end of the tension member (left in FIG. 1 and FIG. 2).

The spring stiffnesses of the extension sections 9 are thereby selected and graduated (stepped) in such a manner that force introduction in each clamping block 3 occurs through shearing stress in the adhesive layer 4, which prevents the development of spikes in shearing stress that exceed the maximum admissible shearing stress in the adhesive and which would lead to a breakdown of cohesion. Adhesion can also occur in the area of the extension sections 9, deviating from the embodiments illustrated in the drawings.

The varying spring stiffness of the extension sections 9 can be constructively achieved in various ways; preferred examples are hereby illustrated in the following drawings.

Figure 4:
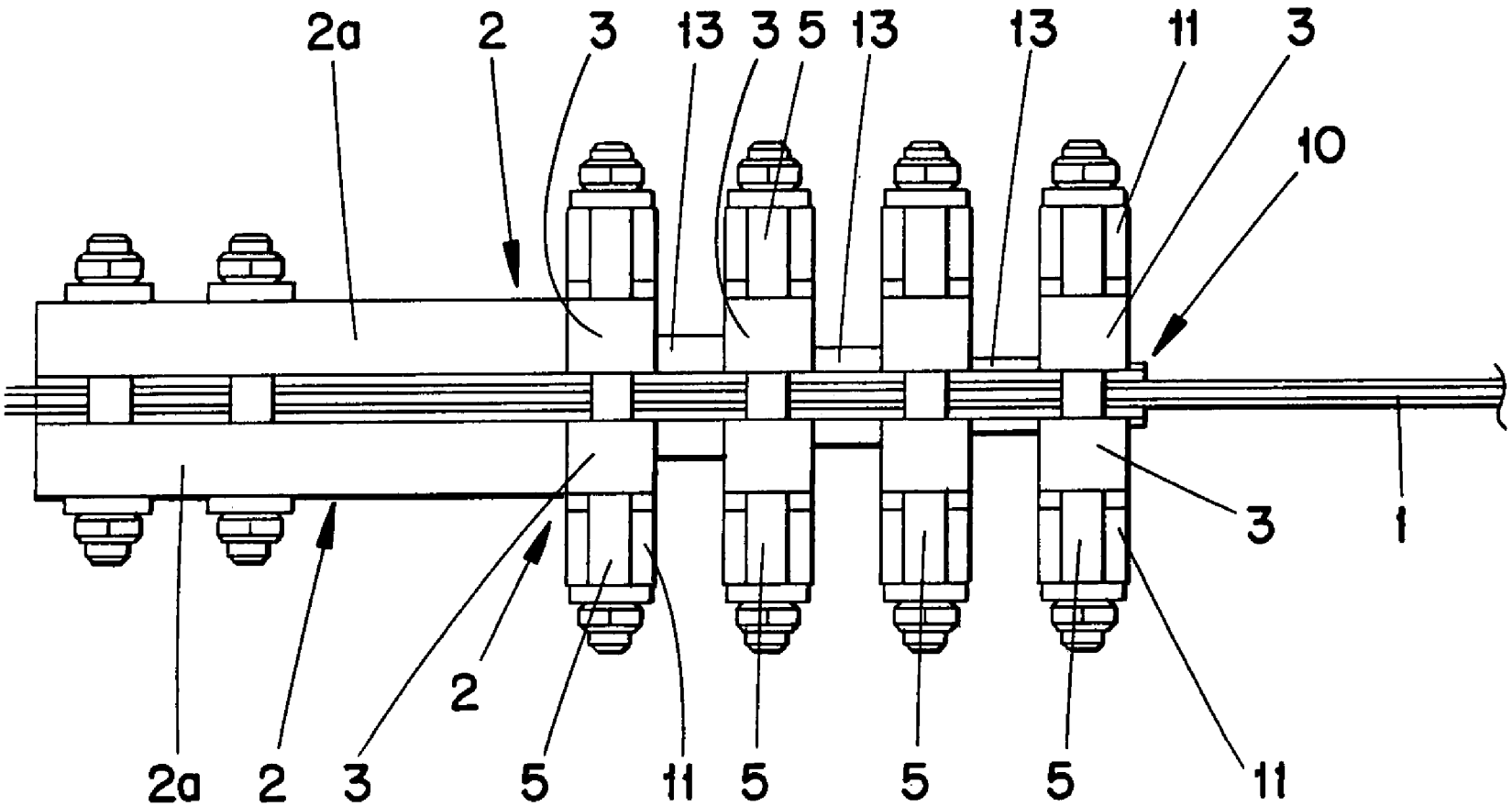
FIG. 4 shows a side view of the tie rod in FIG. 3 whereby the support on a fixed abutment is not shown for the sake of clearer illustration.
Figure 5:
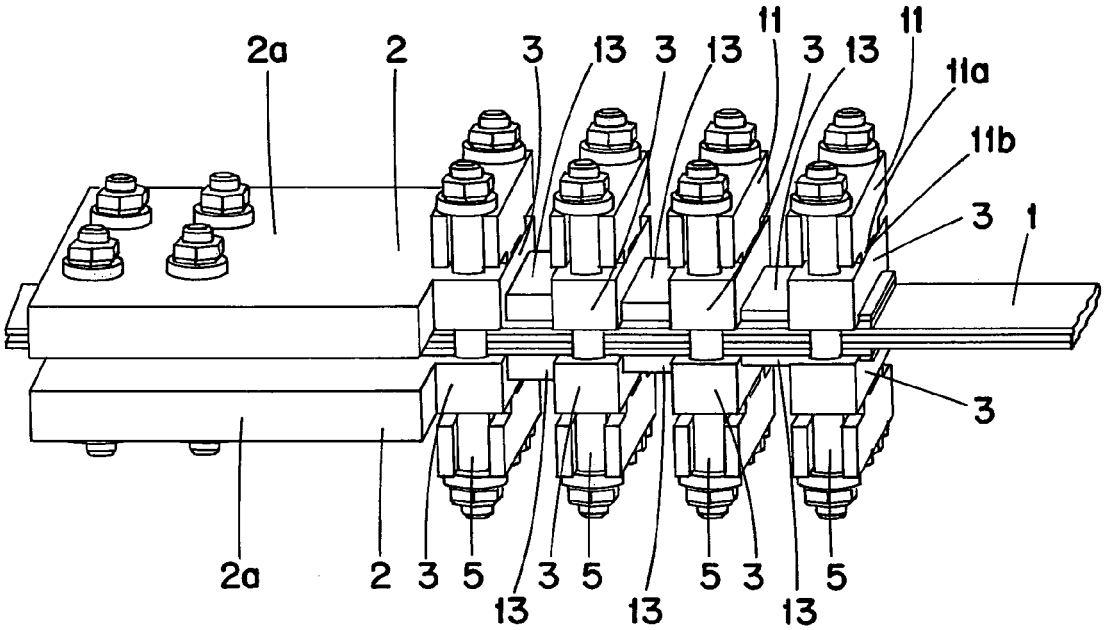
FIG. 5 shows a spatial illustration of the tie rod in FIG. 4.

In the embodiment example of a tie rod for tension members 1 illustrated in FIG. 3 through FIG. 5, consisting of plastic lamellae reinforced with carbon fibers, for example, there is arranged an anchoring body 2 at both sides of a layer of two strip-type tension members 1 whereby its clamping blocks 3 disposed on top of each other are interconnected and clamped by means of tension bolts 5 that are respectively arranged laterally adjacent to the tension member 1 in straddling relationship thereto. For the purpose of uniform force introduction, the tension bolts 5 bias the respective clamping blocks 3 through a transverse connecting piece 12 and through two juxtaposed support areas 11*a* and 11*b*. A single central support area can also be selected in place thereof. A plurality of individually functioning identical tie rods can be combined by stacking on top of one another as a modulus to a larger tension member whereby longer common tension bolts 5 are used.

The last clamping block 3 toward the end of the tension member 1 is connected to an end plate 2*a* of the anchoring body 2. Said end plate 2*a* is supported on the fixed abutment 7 via lateral hydraulic tensioning cylinders 8.

The extension sections 9 between the clamping blocks 3 are formed by connecting pieces 13, which are uniform in width but are of varying thickness. The thickness of the connecting pieces increases from the transition point 10 toward the end plate 2*a*, and thus toward the end of the tension member 1.

FIG. 6 shows in a top view and in a simplified manner of illustration the basic design of the anchoring body 2 as it is used in the embodiment example according to FIG. 3 through FIG. 5. Additional embodiment examples are illustrated in FIG. 8 through FIG. 15 in the same manner of illustration.

Figure 8:
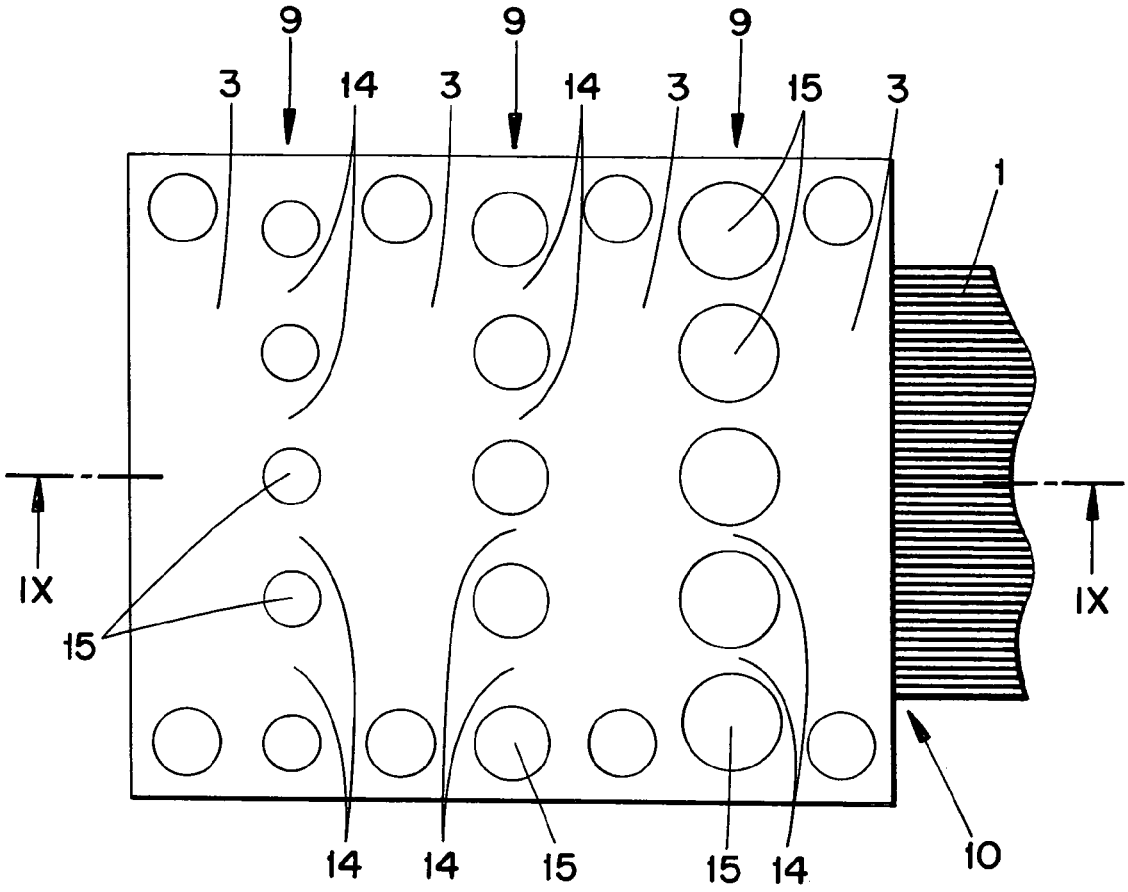
Figure 9:
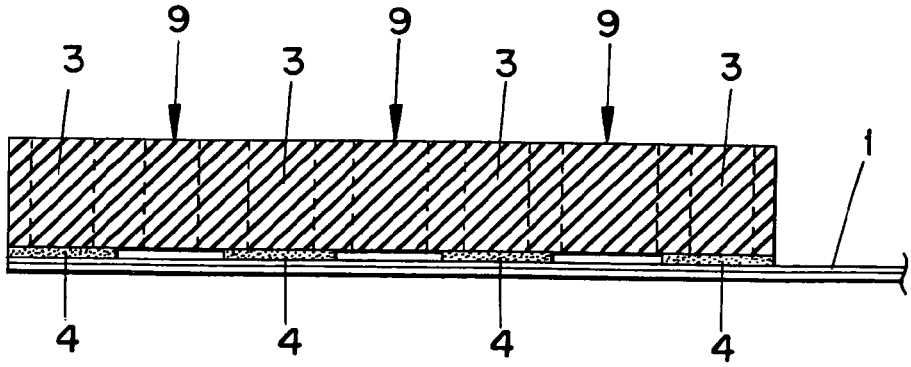

In the example according to FIG. 8 and FIG. 9, the connecting pieces forming the extension sections 9 between the clamping blocks 3 consist respectively of a plurality of connecting sections 14, which are separated from each other by recesses, and of borings 15 running perpendicular relative to the strip-type tension member 1. The respective entire connection cross section of all connecting sections 14 of the individual extension sections 9 are all different from one another. As it is shown in FIG. 8 and FIG. 9, the borings 15 in the extension section 9 disposed closest to the transition point 10 have the largest diameter so that the entire connection cross section of all connecting sections 14 is here the smallest. The diameters of the boring 15 are smaller in the subsequent extension section 9 and the entire cross section of the connecting piece is thereby larger. Finally, the diameters of the borings 15 in the extension section 9 next to the end of the transition member 1 are even smaller and the entire cross section of the connecting piece is larger.

The embodiment example in FIG. 10 and FIG. 11 differs from the afore-described embodiment example substantially by the fact that the borings 15' separating the connecting sections 14' of each extension section 9 run parallel to the surface of the strip-type tension member 1 and transverse (orthogonally) to the longitudinal direction of the strip. Each boring 15' separates from each other two connecting sections 14' within each extension section 9. The diameter of the borings 15' decrease here also starting from the transition point 10 while the entire cross section of the connection sections 14' increases.

In the embodiment example in FIG. 12 and FIG. 13, a bending section 16 is formed in each extension section 9 oriented transverse (orthogonally) to the longitudinal direction of the tension member 1. The bending sections of the individual extension sections 9 have different degrees of flexural strength.

The bending sections 16 or bending beams are placed in a slot 17 which extends into the anchoring body 2 between the two opposing sides of the tension member.

The decreasing depth of the slot 17 starting from the transition point 10 receives the effective length of the bending section 16. The increasing space in the respective neighboring slots 17, starting from the transition point 10, is reached at the same time so that the thickness of the bending sections 16 increases. Both measures, usable individually or in combination, lead to the fact that the spring stiffness of the bending sections 16 increases starting from the transition point 10 and continues toward the end of the tension member 1.

In the embodiment example in FIG. 14 and FIG. 15, the extension sections 9 between the clamping blocks consist of material of varying elasticity modulus. The elasticity modulus of the material used for the extension sections 9 increases starting at the transition point 10, which means, the spring stiffnesses of the extension sections 9 increase toward the end of the tension member 1.

The stepped gradient of the anchor stiffness with graduation in the "load transfer zone" by means of bonding material and the "extension zones" preferably without a bond serve to forward as much tensile force from the lamella to the load introduction zone as can be transferred through the selected bonding principle (adhesion+transverse pressure or friction+transverse pressure) without experiencing any damage. This load introduction zone avoids subsequent additional stresses through widening of the extension zone and the next load transfer zone is then activated. In the ideal situation, each load introduction zone transfers a specific portion of the total tensile force from the tension member. These portions are kept in the anchor part until final transfer to the component. The thereby necessary extensions in the extension zones must be achieved through matching spring stiffness. The number of "clamping blocks", which are to be employed one behind the other, is determined by the amount of load in the tension member and the admissible stress of the selected bonding principle (adhesion/cohesion or pure friction of anchor surfaces against the tension member). The adhesive joint is thereby activated at the entire length in contrast to conventional adhesion without an alternate arrangement of load introduction and extension compensation.

The invention claimed is:

1. A tie anchor for tension members, the tension member comprising a strip having opposing sides, the tie anchor comprising an anchor body disposed on at least one of the strip sides and including at least first, second, and third clamping blocks arranged at a distance from one another in a longitudinal direction of the strip, the clamping blocks connected to the one strip side by at least one of: adhesive and friction; wherein the first clamping block constitutes a last clamping block disposed at an anchoring end of the tension member and is adapted to be supported on a fixed abutment, wherein the second and third clamping blocks are interconnected by a first extension section having a first spring stiffness, and the first and second clamping blocks are interconnected by a second extension section having a second spring stiffness greater than the first spring stiffness.

2. The tie anchor according to claim 1 wherein the anchor body constitutes a first anchor body, the tie anchor further including a second anchor body disposed on the other side of the strip; wherein the first and second anchor bodies are interconnected by clamping elements.

3. The tie anchor according to claim 2 wherein the clamping elements comprise tension bolts extending through the first and second anchor bodies in straddling relationship to the strip.

4. The tie anchor according to claim 1 wherein the extension members comprise respective connection pieces having different respective cross sectional sizes.

5. The tie anchor according to claim 4, wherein the connection pieces have substantially equal widths and different thicknesses.

6. The tie anchor according to claim 4 wherein the connecting pieces comprise respective connecting sections separated from each other by recesses formed in the anchor body.

7. The tie anchor according to claim 6, wherein the recesses comprise bores extending perpendicular to the strip.

8. The tie anchor according to claim 6, wherein the recesses comprise bores extending orthogonally relative to a longitudinal direction of the strip.

9. The tie rod according to claim 1 wherein each extension section includes a bending section extending orthogonally relative to a longitudinal direction of the strip, wherein the bending sections of respective extension sections have different respective degrees of flexural strength.

10. The tie rod according to claim 1 wherein each extension section includes first and second slots extending into the anchor body from respective sides thereof, a portion of each extension section disposed between the first and second slots thereof defining a bending section.

11. The tie anchor according to claim 10, wherein the bending sections are of different respective thicknesses.

12. The tie anchor according to claim 10 wherein the bending sections are of different respective lengths.

13. The tie anchor according to claim 1 wherein the extension sections comprise respective materials having different respective modulii of elasticity.

14. The tie anchor according to claim 1 wherein the first clamping block carries connectors for connecting the anchor body to a fixed abutment.

15. The tie anchor according to claim 1 wherein the strip comprises a fiber-reinforced plastic lamellae.

16. A building structure including a fixed abutment, a tension member comprising a strip having opposite sides, and a tie anchor interconnecting the strip and the fixed abutment; the tie anchor comprising an anchor body disposed on at least one of the strip sides, and including a plurality of clamping blocks arranged at a distance from each other in a longitudinal direction of the strip; the clamping blocks being connected to the one strip side by at least one of: adhesive and friction; wherein an end-most clamping block is secured to the fixed abutment; adjacent clamping blocks being interconnected by expansion sections, each expansion section defining a spring stiffness, wherein the respective spring stiffnesses become progressively stronger toward the end-most clamping block.

* * * * *